US008299000B2

(12) United States Patent
Burrington et al.

(10) Patent No.: US 8,299,000 B2
(45) **Date of Patent: *Oct. 30, 2012**

(54) SLOW RELEASE LUBRICANT ADDITIVES GEL

(75) Inventors: James D. Burrington, Gates Mills, OH (US); Bruce H. Grasser, Chardon, OH (US); Herman F. George, Concord, OH (US); John R. Martin, Nixa, MO (US); John K. Pudelski, Beijing (CN); James P. Roski, Willowick, OH (US); Barbara L. Soukup, Chardon, OH (US); Melinda E. Bartlett, Chesterland, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/285,505

(22) Filed: Oct. 31, 2011

(65) Prior Publication Data

US 2012/0067798 A1 Mar. 22, 2012

Related U.S. Application Data

(60) Division of application No. 12/861,148, filed on Aug. 23, 2010, now Pat. No. 8,076,273, which is a continuation of application No. 12/128,042, filed on May 28, 2008, now Pat. No. 7,799,745, which is a continuation of application No. 10/964,435, filed on Oct. 13, 2004, now Pat. No. 7,417,012, which is a continuation of application No. 10/196,441, filed on Jul. 16, 2002, now Pat. No. 6,843,916.

(51) Int. Cl.
*C10M 163/00* (2006.01)
*C10M 169/06* (2006.01)
*C10M 141/00* (2006.01)
*B01D 29/00* (2006.01)

(52) U.S. Cl. ..... 508/110; 508/287; 508/390; 508/391; 508/460; 508/542; 508/586; 210/203; 210/206; 210/416.5

(58) Field of Classification Search ..... 508/391, 508/110
See application file for complete search history.

(56) References Cited

U.S. PATENT DOCUMENTS 2,310,305 A 2/1943 Miller et al.

(Continued)

FOREIGN PATENT DOCUMENTS

EP 0258426 B1 7/1990

(Continued)

OTHER PUBLICATIONS

"Studies on Combustion, Vibration, and Noise in High-Speed Diesel Engines Through Newly Developed Measuring Instruments" (Journal of Eng. For Gas Turbines and Power, Jul. 1988, vol. 110, pp. 377-384).

(Continued)

*Primary Examiner* — Ellen McAvoy
(74) *Attorney, Agent, or Firm* — Christopher D. Hilker; David M. Shold

(57) ABSTRACT

A lubricant additive gel formed by the gellation of two or more lubricant additives for the slow release of the additive components into a fluid. The lubricant additive gel slowly releases into its component lubricant additives when contacted with the fluid such as an oil thereby serving as a lubricant fluid such as an oil thereby.

14 Claims, 2 Drawing Sheets

U.S. PATENT DOCUMENTS

| | | | | |
|---|---|---|---|---|
| 3,336,223 | A | 8/1967 | Kneeland | 252/9 |
| 3,749,247 | A | 7/1973 | Rohde | 210/205 |
| 3,883,439 | A | 5/1975 | Bergeron | 252/37.2 |
| 4,014,794 | A | 3/1977 | Lewis | 210/199 |
| 4,061,572 | A | 12/1977 | Cohen et al. | 210/168 |
| 4,066,559 | A | 1/1978 | Rohde | 252/10 |
| 4,075,098 | A | 2/1978 | Paul et al. | 210/168 |
| 4,144,166 | A | 3/1979 | DeJovine | 210/60 |
| 4,144,169 | A | 3/1979 | Grueschow | 210/168 |
| 4,601,799 | A | 7/1986 | Froberger et al. | 204/181.8 |
| 4,639,255 | A | 1/1987 | Schuettenberg et al. | 44/62 |
| 4,751,901 | A | 6/1988 | Moor | 123/196 A |
| 4,755,289 | A | 7/1988 | Villani | 210/132 |
| 4,769,167 | A | 9/1988 | Haas et al. | 252/76 |
| 4,906,389 | A | 3/1990 | Brownawell et al. | 252/25 |
| 4,977,871 | A | 12/1990 | Brownawell et al. | 123/196 A |
| 5,032,259 | A | 7/1991 | He et al. | 210/133 |
| 5,042,617 | A | 8/1991 | Brownawell et al. | 184/6.24 |
| 5,059,217 | A | 10/1991 | Arroyo et al. | 44/639 |
| 5,069,799 | A | 12/1991 | Brownawell et al. | 210/749 |
| 5,249,552 | A | 10/1993 | Brooks | 123/1 |
| 5,327,861 | A | 7/1994 | Rogalla et al. | 123/196 S |
| 5,374,354 | A | 12/1994 | Baehler et al. | 210/168 |
| 5,422,022 | A | 6/1995 | Chamberlin, III | 252/32.5 |
| 5,435,912 | A | 7/1995 | Baehler et al. | 210/168 |
| 5,456,217 | A | 10/1995 | Thunker et al. | 123/1 A |
| 5,478,463 | A | 12/1995 | Brownawell et al. | 208/180 |
| 5,507,942 | A | 4/1996 | Davis | 210/94 |
| 5,527,452 | A | 6/1996 | Grigoriev et al. | 210/130 |
| 5,552,040 | A | 9/1996 | Baehler et al. | 210/168 |
| 5,573,557 | A | 11/1996 | Thünker et al. | 44/639 |
| 5,580,359 | A | 12/1996 | Wright | 44/321 |
| 5,591,330 | A | 1/1997 | Lefebvre | 210/203 |
| 5,662,799 | A | 9/1997 | Hudgens et al. | 210/192 |
| 5,695,531 | A | 12/1997 | Makino et al. | 44/639 |
| 5,718,258 | A | 2/1998 | Lefebvre et al. | 137/268 |
| 5,725,031 | A | 3/1998 | Bilski et al. | 141/2 |
| 5,767,045 | A | 6/1998 | Ryan | 508/287 |
| 5,776,494 | A | 7/1998 | Guskey et al. | 424/484 |
| 5,837,657 | A | 11/1998 | Fang et al. | 508/363 |
| 5,897,770 | A | 4/1999 | Hatch et al. | 210/101 |
| 6,008,165 | A | 12/1999 | Shanklin et al. | 508/185 |
| 6,045,692 | A | 4/2000 | Bilski et al. | 210/198.1 |
| 6,187,721 | B1 | 2/2001 | Goldblatt et al. | 508/221 |
| 6,207,625 | B1 | 3/2001 | Ogano et al. | 508/365 |
| 6,238,554 | B1 | 5/2001 | Martin, Jr. et al. | 210/109 |
| 6,268,316 | B1 | 7/2001 | Tanaka et al. | 508/291 |
| 6,520,902 | B1 | 2/2003 | Brown et al. | 494/24 |
| 6,579,218 | B1 | 6/2003 | May et al. | 494/24 |
| 6,689,725 | B1 | 2/2004 | Gao | 508/364 |
| 6,784,142 | B2 | 8/2004 | Van Dam et al. | 508/192 |
| 6,843,916 | B2 * | 1/2005 | Burrington et al. | 210/416.5 |
| 6,860,241 | B2 | 3/2005 | Martin et al. | 123/1 A |
| 7,056,870 | B2 | 6/2006 | Chapaton et al. | 508/208 |
| 7,087,674 | B2 | 8/2006 | Sarkar et al. | 524/560 |
| 7,163,482 | B2 | 1/2007 | Sarkar et al. | 475/159 |
| 7,417,012 | B2 * | 8/2008 | Burrington et al. | 508/287 |
| 7,534,747 | B2 * | 5/2009 | Burrington et al. | 508/113 |
| 7,799,745 | B2 * | 9/2010 | Burrington et al. | 508/287 |
| 7,833,955 | B2 * | 11/2010 | Burrington et al. | 508/391 |
| 8,022,021 | B2 * | 9/2011 | Burrington et al. | 508/192 |
| 8,076,273 | B2 * | 12/2011 | Burrington et al. | 508/110 |
| 2002/0043495 | A1 | 4/2002 | Beard et al. | 210/416.1 |
| 2004/0014614 | A1 | 1/2004 | Burrington et al. | 508/287 |
| 2004/0157751 | A1 | 8/2004 | Chapaton et al. | 508/124 |
| 2004/0157970 | A1 | 8/2004 | Sarkar et al. | 524/366 |
| 2004/0159304 | A1 | 8/2004 | Caracciolo | 123/196 R |
| 2004/0266631 | A1 | 12/2004 | Burrington et al. | 508/113 |

FOREIGN PATENT DOCUMENTS

| | | |
|---|---|---|
| EP | 0254776 B1 | 3/1991 |
| EP | 0416907 | 3/1991 |
| EP | 0915730 B1 | 5/1999 |
| EP | 0962518 | 12/1999 |
| EP | 1213341 | 6/2002 |
| WO | WO 94/24237 | 10/1994 |
| WO | WO 03/018163 | 3/2003 |
| WO | WO 2005/003265 | 1/2005 |
| WO | WO 2005/003266 | 1/2005 |

OTHER PUBLICATIONS

"Deliverables Prepared for Lubrizol", R. Kolar and S. Cullen, Cupertino, CA (Arigin Consulting, Aug. 23, 2001).

"Blending of Alcohols with Diesel Fuels", US/GLO/83/039, E.J. Lom and R.R. Reeves, (U.S. Dept. of Commerce, Natl. Tech. Information Service, Springfield, VA, Jan. 3, 1986, pp. 1-243).

"A Review of Zinc Dialkyldithiophosphates (ZDDPS): Characterisation and Role in the Lubricating Oil", A.M. Barnes, K.D, Bartle, V.R.A. Thibon, Elsevier Science Ltd. (Tribology International 34 [2001], pp. 389-395).

Pirro, D.M. and Wessol, A.A. Lubrication Fundamentals, 2nd Ed. Marcel Dekker, NY 2001, Chapter 3.

* cited by examiner

SLOW RELEASE LUBRICANT ADDITIVES GEL

This application is a continuation of prior application U.S. Ser. No. 12/861,148 filed Aug. 23, 2010 and claims benefit of said prior application, which was itself a continuation of U.S. Ser. No. 12/128,042 filed May 28, 2008, which was itself a continuation of U.S. Ser. No. 10/964,435 filed in Oct. 13, 2004, which was itself a continuation of U.S. Ser. No. 10/196,441 filed 16 Jul. 2002 and claims the benefit of said prior applications.

FIELD OF THE INVENTION

The present invention relates to a gel form of lubricant additives that will slow-release into a fluid. Furthermore, the present invention relates to an engine lubricating additive gel that will slow release into an oil being filtered, i.e. that will release slowly so that the additives continue to be released over a substantial portion to all of the oil's useful life.

BACKGROUND OF THE INVENTION

Slow-release lubricant additives in oil filters are known. The additives in some of these filters are incorporated into thermoplastic polymers which slowly dissolve into the oil being processed. See, for example, U.S. Pat. No. 4,075,098. In others, the additives are incorporated into polymers which are oil-permeable at elevated engine temperatures. See, for example, U.S. Pat. No. 4,066,559. In still others, the additives are incorporated into particles which are oil-insoluble but oil-wettable. See, for example, U.S. Pat. No. 5,478,463. In still another approach, oil-soluble solid polymers capable of functioning as viscosity improvers are provided inside an oil filter, with or without additional additives being incorporated into the polymer. See, for example, U.S. Pat. No. 4,014,794.

Although these systems are capable of introducing lubricant additives into the oil being filtered, they typically require inert carriers for slow release of the additives into the oil. In others, complicated mechanical systems such as capsules, perforated sheets, baffles, specially-designed injectors and/or additional compartments are needed for achieving slow release. See, for example, U.S. Pat. No. 5,718,258.

Accordingly, it would be desirable to provide slow release lubricant additives which do not require inert carriers or complicated mechanical systems for achieving slow-release metering of the additives into a fluid such as an oil.

SUMMARY OF THE INVENTION

In accordance with the present invention, it has been discovered that lubricant additive gels can slowly provide lubricant additives to a fluid such as an oil. In particular, it has been found that the oil-soluble lubricant additive gels slowly dissolve to their component lubricant additive parts when exposed to the oil flowing through an oil filter. Because the rate of dissolution of these gels is so slow, and because these gels dissolve into their component lubricant additives, they effectively achieve slow release of these additives into the oil being filtered. Hence, they can be used as is, without an inert carrier or a non lubricant additive matrix, such as a polymeric backbone or complicated mechanical systems needed in earlier systems for achieving slow release of lubricant additives.

Accordingly, the present invention provides a new process for supplying one or more lubricant additives slowly to the oil by contacting the oil with oil lubricant additives in the form of a lubricant additive gel.

In addition, the present invention provides, a new composition of matter, a lubricant additive package comprising a lubricant additive being formed by combining an overbased detergent with a succinimide dispersant.

Furthermore, the present invention provides a new oil filter for use in commercial and/or industrial systems such as on an internal combustion engine. The filter comprises a housing, a filter for removing particulate matter from the oil passing through the filter and oil-soluble lubricant additives inside the housing for slow release into the oil, wherein at least some of the oil-soluble lubricant additives are in the form of a lubricant additive gel.

The present invention of a lubricant additive gel can be used in any fluid conditioning device including but not limited to internal combustion engines, stationary engines, lubricated mechanical systems, hydraulic systems and the like.

BRIEF DESCRIPTION OF THE DRAWINGS

The present invention may be more readily understood by reference to the following drawings in which.

DETAILED DESCRIPTION

In accordance with the present invention, a slow release lubricant additive package in the form of a lubricant additive gel is provided for fluid conditioning devices. The lubricant additive gel is used in lubricated mechanical systems for the slow release of the components of the gelled lubricant, specifically formulated to meet the performance requirements of the system. Further, the slow release of the component of the gelled lubricant additive conditions the fluid. The lubricated mechanical systems include but are not limited to those in internal combustion (both SI and CI) engines, natural gas engines, stationary engines, metal working coolant systems, medium and high speed marine diesel engines, lubricated mechanical systems, industrial lubricated systems, oil filters, hydraulic systems, transmission systems, and the like.

Filter Structure

Figure 1:
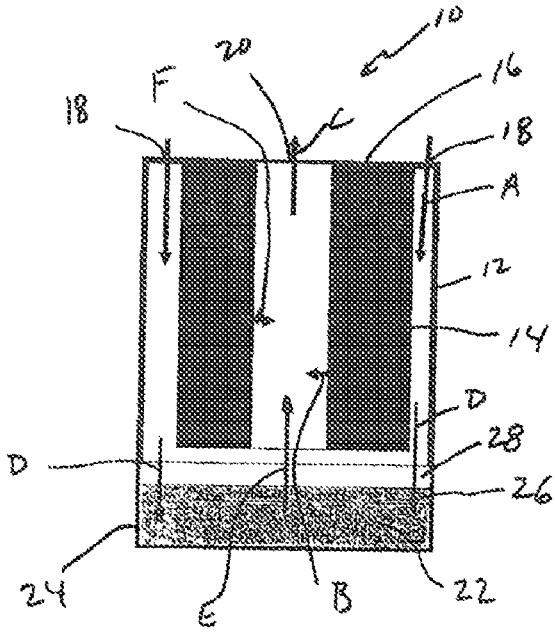
FIG. 1 is a schematic representation of an oil filter made in accordance with the present invention.

The inventive oil filter is schematically illustrated in FIG. 1 which shows an oil filter generally at 10 composed of a housing 12, a filter media element 14 for removing particulate contaminants from the oil and an end plate 16. End plate 16 defines inlet openings 18 and an outlet opening 20 arranged so that oil travels into filter 10, through filter element 14 and then out of filter 10 in the direction generally indicated by arrows A, B and C, respectively.

Oil lubricant additive gel 22 is held inside housing 12 in a manner so that it comes into intimate contact with oil in the filter. In the particular embodiment shown, lubricant additive gel 22 is held in reservoir 24 in a lower portion of housing 12 by a Teflon mesh screen 26 and perforated plate 28. The openings in screen 26 and plate 28 allow oil to move in the direction of arrows D and E and thereby come into contact with lubricant additive gel 22. In accordance with the present invention, lubricant additive gel 22 is a gel produced by combining two or more of the oil-soluble lubricant additives forming lubricant additive gel 22. Such lubricant additive gels, it has been found, slowly dissolve into their component lubricant additives when exposed to the oil in filter 10, thereby yielding these additives for incorporation into the oil. By suitable control of the chemistry of the lubricant additive gel 22, the rate at which lubricant additive gel 22 dissolves into its component lubricant parts, can be easily controlled.

Figure 2:
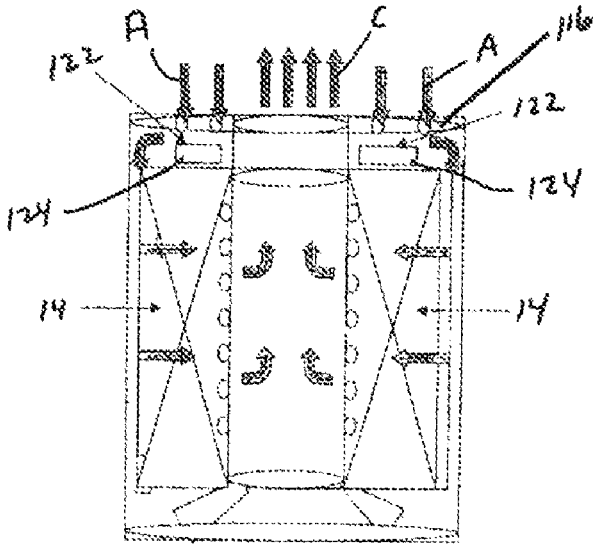
FIG. 2 is a schematic representation of another oil filter made in accordance with the present invention.

Another embodiment of the inventive oil filter is illustrated in FIG. 2, in which like reference numbers indicate the same elements as in the oil filter of FIG. 1. The structure of this filter is similar to that of the FIG. 1 filter, except that reservoir 124 is arranged near end plate 116 so that all or substantially all of the oil passing into the filter contacts lubricant additive gel 122. In the filter of FIG. 1 some of the oil bypasses reservoir 24 as shown by arrow F. It will therefore be appreciated that the portion of the oil entering the filter which contacts gel 22/122, and hence the rate at which this gel dissolves into its component lubricant parts, can be further controlled by suitable selection of the design and location of reservoir 24/124.

For example, although the above description indicates that lubricant additive gel 22 is deposited in a reservoir at the bottom of the oil filter, any shape, structure and/or arrangement can be used which brings the oil into intimate contact with the lubricant additive gel. For example, the lubricant additive gel can be deposited on filter element 14, if desired. Alternatively, any of the other mechanical systems and arrangements such as those described in the above-noted U.S. Pat. No. 4,014,749; U.S. Pat. No. 4,061,572; U.S. Pat. No. 4,066,559; U.S. Pat. No. 4,075,097; U.S. Pat. No. 4,075,098; U.S. Pat. No. 4,144,166; U.S. Pat. No. 4,144,169; U.S. Pat. No. 4,751,901; U.S. Pat. No. 5,327,861; U.S. Pat. No. 5,552,040 and U.S. Pat. No. 5,718,258 can be also be used. It should be appreciated that the location of the gel in a mechanism, such as the filter or any location outside the filter that would provide access to the gel slowly releasing into the fluid; the mechanism to hold the gel if any; the configuration of the device, for example the filter or the gel holder; or the design is not critical, and generally can be any of those known for slow release agents or mechanisms.

It should also be appreciated that the above structures are illustrative only of an oil filter and, since the lubricant additive gel can be used in any lubricated mechanical system, the oil filter can have any structure which allows the oil being filtered to come into contact with a lubricant additive gel.

Lubricant Additive Gels

Modern motor oils are typically made by combining a pre-formed lubricant additive package with a refined or synthetic base oil stock. Such lubricant additive packages, in turn, are typically made by combining together the various different lubricant additives forming the package. Because lubricant additives are easier to handle and measure if in liquid form, those additives which are normally solid are typically dissolved in small amounts of base oil stock which acts as a carrier before being added to the other ingredients. Moreover, additional amounts, e.g. 40 wt. %, of base oil are normally included in the completed lubricant package, again to make handling and measuring easier.

Most lubricating oils contain many different lubricant additives. When producing lubricant additive packages containing mixtures of lubricant additives, it has been found in industry that unwanted gels occasionally form uncontrolled in the additive package. It has been found that in some situations, depending on the type and/or amount of the additives being used, gellation occurs between two or more of the lubricant additives when combined. See, for example U.S. Pat. No. 6,140,279. Such gels adversely affect the rheological properties of the finished fluid, such as the finished oils in which they are found, and hence are always avoided in practice. The present invention, controls the formation of lubricant additive gels and their application by incorporation into oil filters and other mechanical lubricating systems. The controlled formation of the gel, of the lubricant additive, serves as slow release agents for supplying the lubricant additives from which they are made to the finished fluid.

Gels are materials that comprise mixtures of two or more substances and which exist in a semi-solid state more like a solid than a liquid. See Parker, Dictionary of Scientific and Technical Terms, Fifth Edition, McGraw Hill, © 1994. See, also, Larson, "The Structure and Rheology of Complex Fluids," Chapter 5, Oxford University Press, New York, N.Y., © 1999, which is incorporated herein by reference. The rheological properties of a gel can be measured by small amplitude oscillatory shear testing. This technique measures the structural character of the gel and produces a term called the storage modulus (which represents storage of elastic energy) and the loss modulus (which represents the viscous dissipation of that energy). The ratio of the loss modulus/storage modulus, which is called the loss tangent, or "tan delta," is >1 for materials that are liquid-like and <1 for materials that are solid-like.

In accordance with the present invention, any gel formed from the combination of two or more oil-soluble lubricant additives can be used to make lubricant additive gel 22. The lubricant additive gels include, but are not limited to those gels formed from combining dispersants, gels formed from combining a dispersant and an acid, gels formed from combining a dispersant and a base, gels formed from combining a dispersant and an over-based detergent. Which is described later in the specification. The gels have tan delta values in one embodiment of about $\leqq 1$, in one embodiment of about $\leqq 0.75$, in one embodiment of about $\leqq 0.5$ or in one embodiment of about $\leqq 0.3$.

A category of gels which finds particular use in accordance with the present invention are those in which gellation occurs through the combination of an overbased detergent and an ashless succinimide dispersant. In this embodiment, the ratio of the detergent to the dispersant is typically from about 10:1 to about 1:10, more especially from about 5:1 to about 1:5, from about 4:1 to about 1:1 and even from about 4:1 to about 2:1. In addition, the TBN of the overbased detergent is normally at least 100, more typically at least 300, or even 350 or even 400. Where mixtures of overbased detergents are used, at least one should have a TBN value within these ranges. However, the average TBN of these mixtures may also correspond to these values.

In one embodiment the preferred ashless dispersants in the gels is a polyisobutenyl succinimide. Polyisobutenyl succinimide ashless dispersants are commercially-available products which are normally made by reacting together polyisobutylene having a number average molecular weight ("Mn") of about 300 to 10,000 with maleic anhydride to form polyisobutenyl succinic anhydride ("PIBSA") and then reacting the product so obtained with a polyamine typically containing 1 to 10 ethylene diamine groups per molecule. The dispersant so obtained is typically formed from a mixture of different compounds and can be characterized by a variety of different variables including the degree of its amine substitution (i.e. the ratio of the equivalents of amino groups to carbonylic groups, or the N:CO ratio), its maleic anhydride conversion level (i.e., its molar ratio of maleic anhydride to PIB, as defined in U.S. Pat. No. 4,234,435, incorporated herein by reference), the Mn of its PIB group, and its mode of preparation (thermal assisted succination vs. $Cl_2$-assisted succination). Analogous compounds made with other polyamines (e.g. polypropylene amine) and other alkenyl segments (e.g. polypropenyl) can also be used. Ashless dispersants of this type are described, for example, in U.S. Pat. No. 4,234,435, which is incorporated herein by reference.

Normally, the N:CO ratio of these polyisobutenyl succinimide ashless dispersants will be about 0.6 to 1.6, more typically about 0.7 to 1.4 or even 0.7 to 1.2. In addition or alternatively, the maleic anhydride conversion level of these polyisobutenyl succinimide ashless dispersants will normally be about 1.3, more typically at least about 1.5 or even 1.6 or above. In addition or alternatively, the Mn of the polyisobutenyl segments of these polyisobutenyl succinimide ashless dispersants are normally ≧about 350, more typically at least about 1200, at least about 1500 or even 1800 or above. In addition or alternatively, these polyisobutenyl succinimide ashless dispersants are also made using $Cl_2$-assisted succination rather than thermal assisted succination, since this produces PISA's of higher conversion than thermally-produced PIBSA's (the latter known as DA or direct addition PIBSA's).

The lubricant additive gels used includes a variety of additional ingredients dissolved or dispersed therein. In addition, such gels will normally contain relatively small amounts of base stock oils, refined or synthetic, as many of these additives are most easily supplied, stored and handled if dissolved in such base stocks, as indicated above. Nonetheless, the lubricant additive gels of the present invention will typically contain at least about 30 wt. %, more typically at about 50 wt. %, even 60 wt %, even 70 wt % or even 80 wt. % gel, with the balance being other ingredients as further described herein. Of course, the inventive gels can be composed of 100% gel, if desired.

Many different types of oil-soluble lubricant additives are incorporated into currently-available lubricating oils. Examples include detergents, dispersants, extreme pressure agents, wear reduction agents, anti-oxidants, viscosity index improvers, anti-foaming agents, mixtures thereof and the like.

Oil soluble detergents are known in the art and include but are not limited to overbased sulfonates, phenates, salicylates, carboxylates and the like. Such detergents are described, for example, in U.S. Pat. No. 5,484,542 and the many other patents and publications referred to in that patent. The disclosures of all of these patents and publications are incorporated herein by reference. Combinations of the detergents may be used. The detergents are present in the range from about 0.1% to about 25%, preferably from about 1% to about 20% and more preferably from about 3% to about 15% by weight of the composition in the finished fluid blend.

The detergents include but are not limited to overbased calcium sulfonate detergents. These commercially-available products are typically formed by reacting carbon dioxide with mixtures of lime (calcium hydroxide) and an alkyl benzene sulfonate soap to form calcium carbonate-containing micelles. More than an equivalent amount of lime and carbon dioxide are used so that the product detergent becomes basic in character. Such materials are conveniently described in terms of the total base number ("TBN"), which is a measure of the base capacity of the product. Overbased detergents with TBN's ranging from 10 to 400 are typically used as lubricating oil detergents. Overbased detergents containing metals other than calcium, e.g. Mg, Ba, Sr, Na and K are also included herein.

A wide variety of oil-soluble dispersants are also known. The dispersant can be used in combination. The dispersant are present in the range from about 0.1% to about 25%, preferably from about 1% to about 20% and more preferably from about 3% to about 15% by weight of the composition in the finished fluid blend. Oil-soluble dispersants include but are not limited to ashless-type dispersants and polymeric dispersants. Ashless type dispersants are characterized by a polar group attached to a relatively high molecular weight hydrocarbon chain. Typical ashless dispersants include N-substituted long chain alkenyl succinimides, having a variety of chemical structures including typically:

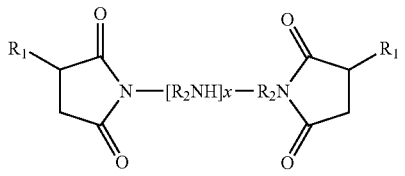

where each $R^1$ is independently an alkyl group, frequently a polyisobutyl group with a molecular weight of 500-5000, and $R^2$ are alkenyl groups, commonly ethylenyl ($C_2H_4$) groups. Succinimide dispersants are more fully described in U.S. Pat. No. 4,234,435, the disclosure of which is incorporated herein by reference. The dispersants described in this patent are particularly effective for producing gels in accordance with the present invention.

Another class of ashless dispersant is high molecular weight esters. Such materials are described in more detail in U.S. Pat. No. 3,381,022.

Another class of ashless dispersant is the Mannich dispersants. These compounds are the reaction products of alkyl phenols in which the alkyl group contains at least about 30 carbon atoms with aldehydes (especially formaldehyde) and amines (especially polyalkylene polyamines). The materials described in U.S. Pat. No. 3,036,003 and U.S. Pat. No. 3,980,569 are illustrative. Mannich bases having the following general structure (including a variety of different isomers and the like) are especially interesting.

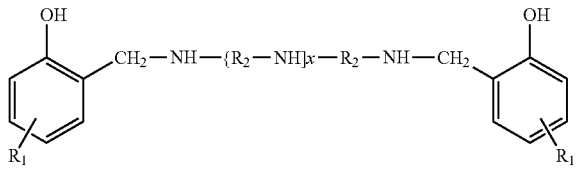

Such materials are described in more detail in U.S. Pat. No. 3,634,515.

Another class of dispersants is carboxylic dispersants. Examples of these "carboxylic dispersants" are described in British Patent 1,306,529 and in many U.S. Patents including U.S. Pat. No. 3,219,666, U.S. Pat. No. 4,234,435, and Re. 26,433.

Amine dispersants are reaction products of relatively high molecular weight aliphatic halides and amines, preferably polyalkylene polyamines. Examples thereof are described, in U.S. Pat. No. 3,275,554 and U.S. Pat. No. 3,565,804.

Polymeric dispersants are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Examples of polymer dispersants thereof are disclosed in the following U.S. Pat. Nos. 3,329,658, and 3,702,300.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

Oil-soluble extreme pressure anti-wear additives include but are not limited to a sulfur or chlorosulphur EP agent, a chlorinated hydrocarbon EP agent, or a phosphorus EP agent, or mixtures thereof. Examples of such EP agents are chlorinated wax, organic sulfides and polysulfides, such as benzyldisulfide, bis-(chlorobenzyl)disulfide, dibutyl tetrasulfide, sulfurized sperm oil, sulfurized methyl ester of oleic acid, sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate, phosphorus esters such as the dihydrocarbon and trihydrocarbon phosphate, i.e., dibutyl phosphate, diheptyl phosphate, dicyclohexyl phosphate, pentylphenyl phosphate; dipentylphenyl phosphate, tridecyl phosphate, distearyl phosphate and polypropylene substituted phenol phosphate, metal thiocarbamates, such as zinc dioctyldithiocarbamate and barium heptylphenol diacid, such as zinc dicyclohexyl phosphorodithioate and the zinc salts of a phosphorodithioic acid combination may be used. The oil soluble EP agents is present in the range of about 0% to 10%, preferably from about 0.25% to about 5% and more preferably from about 0.5% to about 2.5% by weight of the finished fluid blend.

Oil-soluble antioxidants include but are not limited to alkyl-substituted phenols such as 2,6-di-tertiary butyl-4-methyl phenol, phenate sulfides, phosphosulfurized terpenes, sulfurized esters, aromatic amines, and hindered phenols. Another example of an antioxidant is a hindered, ester-substituted phenol, which can be prepared by heating a 2,6-dialkylphenol with an acrylate ester under base catalysis conditions, such as aqueous KOH. Combinations may be used. Antioxidants are typically present in the range of about 0% to about 12%, preferably about 0.1% to 6%, and more preferably about 0.25% to about 3% by weight of the finished fluid blend.

Known antifoams include but are not limited to organic silicones such as dimethyl silicone (add more) and the like. Combinations may be used. Antifoams are normally used in the range of about 0% to about 1%, preferably about 0.02% to about 0.5%, and more preferably 0.05% to about 0.2% by weight of the finished fluid blend.

Viscosity modifiers are also known and commercially available. Combinations of viscosity modifiers may be used. The viscosity modifiers are present in the ranged about 0% to about 20%, preferably about 5% to about 15% and more preferably about 7% to about 10% of the finished fluid blend. VI-modifiers provide both viscosity improving properties and dispersant properties. Examples of dispersant-viscosity modifiers include but are not limited to vinyl pyridine, N-vinyl pyrrolidone and N,N'-dimethylaminoethyl methacrylate are examples of nitrogen-containing monomers. Polyacrylates obtained from the polymerization or copolymerization of one or more alkyl acrylates also are useful as viscosity modifiers Functionalized polymers can also be used as viscosity index modifiers. Among the common classes of such polymers are olefin copolymers and acrylate or methacrylate copolymers. Functionalized olefin copolymers can be, for instance, interpolymers of ethylene and propylene which are grafted with an active monomer such as maleic anhydride and then derivatized with an alcohol or an amine, as described in U.S. Pat. No. 4,089,794. Other such copolymers are copolymers of ethylene and propylene which are reacted or grafted with nitrogen compounds, as described in U.S. Pat. No. 4,068,056. Derivatives of polyacrylate esters are well known as dispersant viscosity index modifier additives. Dispersant acrylate or polymethacrylate viscosity modifiers such as Acryloid™ 985 or Viscoplex™ 6-054, from RohMax, are particularly useful. Solid, oil-soluble polymers such as the PIB, methacrylate, polyalkylstyrene, ethylene/propylene and ethylene/propylene/1,4-hexadiene polymers illustrated in U.S. Pat. No. 4,014,794, can also be used as viscosity index improvers.

Additional Ingredients

As indicated above, a particular advantage of the present invention is that lubricant additive gel 22 can be used as is, i.e. without additional ingredients, since an inert carrier of the type used in earlier systems in not needed to support or meter its lubricant additives. Of course, such an inert carrier can be used if desired. Furthermore, other active ingredients, i.e. ingredients which provide a beneficial function to the oil being filtered, can also be included in lubricant additive gel 22. For example, additional oil-soluble lubricant additives which do not participate in the gel forming reaction can also be included, if desired. In addition, solid, particulate additives such as the PTFE, $MoS_2$ and graphite as shown in U.S. Pat. No. 6,045,692 can also be included. The disclosure of this patent is also incorporated herein by reference. In addition, the solid, oil-soluble and oil-wettable particles described in the patents mentioned in the Background section above can also be included.

Indeed, lubricant additive gels substantially free of inert carriers but containing a significant amount of one or more additional additives are particularly interesting in accordance with the present invention. Thus, lubricant additive gels containing 5, 10, 15, 20, 25, 30, 35 or even 40% or more of such additional lubricant additives, with or without an inert carrier, find particular interest in accordance with the present invention. Lubricant additive gels containing anti-oxidants, viscosity index improvers, wear reduction agents, anti-foam agents and/or additional oil-soluble lubricant additives as additional non-gelling ingredients are useful.

EXAMPLES

In order to more thoroughly illustrate the present invention, the following examples are provided. In these examples, two different lubricant formulations were tested. Each formulation contained a PIB-succinimide dispersant having an N:CO ratio of 0.83 and a maleic anhydride conversion of 1.6 which was made by $Cl_2$-assisted succination of a PIB polymer having an Mn of 2000. Each formulation also contained an overbased Ca-alkylsulfonate detergent having a total base number of 300 or 400. Each formulation also contained nonylated diphenylamine as an antioxidant. The compositions of these two different formulations are set forth in the following table:

TABLE 1

| Component | Formulation A (wt. %) | Formulation B (wt. %) |
|---|---|---|
| 300 TBN Ca-Detergent | 15 | 5 |
| 400 TBN Ca-Detergent | — | 10 |
| PIB-Succinimide Dispersant | 5 | 5 |
| Antioxidant | 5 | 5 |
| Total | 25 | 25 |

The above formulations were prepared by mixing together the ingredients listed above in the order given above. The mixtures so obtained were then allowed to stand at room temperature for a week or heated to 60-100° C. for about an hour. The gel properties of each formulation as measured by the loss tangent, tan delta, was then determined by small amplitude oscillatory shear measurements, and it was found that Formulation A did not form a gel (tan delta value>>1.0) while Formulation B formed a gel having a tan delta number of about 0.3.

Driving Test

The ability of the inventive gelled lubricant additives to slow release into the oil being filtered was determined by a driving test in which a 1989 Honda Accord was driven up to 366 miles in each test, approximately half of which was on the highway and the other half was in stop and go traffic. A new charge of Valvoline All Climate 10w-40 motor oil was placed into the four quart sump of the Accord at the start of each test, and a sample of the motor oil being filtered was periodically withdrawn to determine its detergent concentration. Detergent concentration was measured in two different ways, percent calcium in the oil as determined by ICP and total base number as determined by ASTM D4739.

Three separate tests were run, each of which used a FRAM PH3593A oil filter of the general structure illustrated in FIG. 2. In the first test, Control No. 1, no lubricant additives were included in the filter. In the second, Comparative Example A, about 25 gms of ungelled Formulation A was placed on top of the pressure relief valve on the "dirty' side of the filter, as shown at 122 in this. In the third, Example 1, about 25 gms of gelled Formulation B in accordance with the present invention was included in the filter.

The results obtained are set forth in the following Table 2:

TABLE 2

Driving Test
Detergent Concentration

| | % Ca | | | TBN | | |
|---|---|---|---|---|---|---|
| Miles | Control 1 | Comp A | Example 1 | Control 1 | Comp A | Example 1 |
| 0 | 0.1841 | 0.1925 | 0.1928 | 5.7 | 5.9 | 6 |
| 9 | | 0.2251 | 0.2102 | | 6.6 | 6.9 |
| 16 | 0.1916 | | | 5.7 | | |
| 48 | 0.1937 | | | 5.6 | | |
| 67 | | 0.2319 | | | 6.6 | |
| 116 | 0.2013 | | | 5.2 | | |
| 117 | | 0.2322 | | | 6.7 | |
| 137 | | | 0.2299 | | | 6.3 |
| 210 | 0.1977 | | | 5.5 | | |
| 260 | 0.1998 | | | 5.2 | | |
| 366 | | | 0.2441 | | | 6.8 |

From Table 2, it can be seen that the Ca concentration of the oil being filtered by the control filter remained essentially constant over the course of the test indicating a constant detergent concentration (the only source of Ca). In contrast, the detergent concentration in Comparative Example A in which ungelled Formulation A was used increased immediately to a relatively high level where it remained over the course of the test. This shows that lubricant additives which are present in an ungelled mixture do not slow release into the oil but rather release substantially completely as soon as the filter is used. In Example 1 in accordance with the present invention, however, the Ca concentration increased slowly over the course of the test and was still increasing by test termination. This shows that the gelled lubricant additives in this filter slow released into the oil being filtered, thereby demonstrating the slow-release capability of the gelled lubricant additives.

Stationary Engine Tests

The above tests were repeated except that a stationary Honda model ES6500 359 cc, 12.2 hp (max) internal combustion engine on a 6500 watt max output electrical generator was used. This engine had a 1.5 quart oil sump which was filtered at a rate of 2.25 gpm. The engine was operated on a continuous (i.e. constant power) basis at a average oil temperature of 93° C. and required oil make up at a replenishment rate of 6 oz./day.

Four different tests were run, a control with no added lubricants, a comparative example using Formulation A and two examples of the present invention using Formulation B. Example 3 differed from all of the other examples in that after filling with Formulation B, but before being used, the outside of the filter was heated to about 100-200° C. for about 5 minutes. The purpose of this example was to determine if the heat adversely affected filter performance.

The results obtained are set forth in the following Table 3:

TABLE 3

Stationary Engine Test
Detergent Concentration

| | % Ca | | | | TBN | | | |
|---|---|---|---|---|---|---|---|---|
| Hours | Contr 2 | Comp B | Ex 2 | Ex 3 | Contr 2 | Comp B | Ex 2 | Ex 3 |
| 0 | 0.1925 | 0.1925 | 0.1925 | 0.1925 | 5.9 | 5.9 | 5.9 | 5.9 |
| 24 | 0.1968 | 0.3135 | 0.2069 | 0.2650 | 5.2 | 7.9 | 5.3 | 5.8 |
| 48 | 0.1996 | 0.3036 | 0.2278 | 0.2131 | 4.7 | 7.3 | 5.5 | 5.9 |
| 72 | 0.2024 | | 0.2184 | 0.2246 | 4.8 | 8.2 | 5.5 | 4.9 |
| 96 | 0.1939 | 0.3384 | 0.2198 | 0.2253 | 5.0 | 8.1 | 5.2 | 5.0 |
| 120 | 0.2073 | 0.3268 | 0.2241 | 0.2300 | 4.4 | 7.7 | 5.0 | 5.2 |

Like the previous tests, these tests also show that when ungelled Formulation A is used, the Ca concentration increases to relatively high, steady state value immediately after filtering has begun. In contrast, Ca concentration increases much more slowly when gelled Formulation B in accordance with the present invention is used. This again demonstrates the slow release capability of the incentive gel. Example 3 also shows that the commercial painting operation did not adversely affect the performance of the incentive gel.

Stationary Engine Tests—Bagged Additives

The above stationary engine tests were repeated, except that the lubricant additive formulations were placed in an LLDPE (linear low density polyethylene) bag prior to insertion into the filter. This was done to facilitate handling of the additive formulations, since the bags were made from materials that would dissolve or melt on contact with oil at operating temperatures thus releasing the additive gel formulations for contact with the oil being filtered.

Three tests were run, a control with no additive package, a comparative example using Formulation A and an example of the present invention using Formulation B. The results obtained are set forth in the following Table 4:

TABLE 4

Stationary Engine Test
Detergent Concentration

| | % Ca | | | TBN | | |
|---|---|---|---|---|---|---|
| Hours | Control 3 | Comp C | Example 4 | Control 3 | Comp A | Example 4 |
| 0 | 0.1925 | 0.1925 | 0.1925 | 5.9 | 5.9 | 5.9 |
| 24 | 0.1892 | | 0.2056 | 4.6 | | 5.5 |
| 48 | 0.1871 | | 0.2017 | 4.5 | 8.3 | 5.2 |

TABLE 4-continued

| Stationary Engine Test Detergent Concentration | | | | | | |
|---|---|---|---|---|---|---|
| | % Ca | | | TBN | | |
| Hours | Control 3 | Comp C | Example 4 | Control 3 | Comp A | Example 4 |
| 72 | 0.1955 | 0.3020 | 0.2058 | 3.5 | 8.4 | 5.2 |
| 96 | Oil Leak | 0.3015 | 0.2211 | Oil Leak | 8.2 | 4.1 |
| 120 | | 0.2638 | 0.2194 | | 7.1 | 4.2 |

Like the previous stationary engine tests, these tests also show that the lubricant additive package in the form of a gel, is capable of providing lubricant additives to the oil being filtered on a slow release basis, whereas essentially the same filter containing essentially the same additive package in ungelled form cannot.

Although only a few embodiments of the present invention have been described above, it should be appreciated that many modifications can be made without departing from the spirit and scope of the invention. All such modifications are intended to be included within the scope of the present invention, which is to be limited only by the following claims:

We claim:

1. A lubricant additive package comprising one or more lubricant additives in the form of a lubricant additive gel that slow releases the lubricant additive components into a fluid;

wherein the lubricant additive gel has a tan delta value of $\leqq 0.75$.

2. The lubricant additive package of claim 1, wherein the lubricant additive gel is formed by the gellation of at least two lubricant additives selected from the group comprising detergents, dispersants, acids, bases, over based detergents and combinations thereof.

3. A lubricant additive package of claim 1, wherein the lubricant additive gel is formed from a detergent and dispersant.

4. The lubricant additive package of claim 2, wherein the dispersant is an ashless dispersant or a polymeric dispersant.

5. The lubricant additive package claim 2, wherein the detergent is a sulfonate, phenate, salicylate carboxylate or mixtures thereof.

6. The lubricant additive package of claim 2, wherein the dispersant is selected from the group comprising an N-substituted long chain alkenyl succinimides, polyisolbutenyl succinimide, a high molecular weight ester, a Mannich base, an amine dispersant, a polymeric dispersant or mixtures thereof.

7. The lubricant additive package of claim 2, wherein the lubricant additive gel contains at least one additional lubricant additive not participating in gel formation, the additional lubricant being selected from the group comprising antioxidants, anti-foam agents, wear reductions agents, viscosity improvers, extreme pressure agents or mixtures thereof.

8. The lubricant additive package of claim 1, in which at least 30 wt. % of the package is composed of a gel formed by combining an overbased detergent having a TBN of at least 300 and a polyisobutenyl succinimide dispersant having at least one of the following properties:

(a) the N:CO ratio of the polyisobutenyl succinimide is 0.6 to 1.6, (b) the maleic anhydride conversion level of the polyisobutenyl succinimide is at least about 1.3, (c) the Mn of the polyisobutenyl segment of the polyisobutenyl succinimide is at least about 1200, and (d) the polyisobutenyl succinimide is made by $Cl_2$-assisted succination.

9. A process for supplying one or more lubricant oil additives to a fluid comprising contacting the fluid with a lubricant additive gel;

wherein the lubricant additive gel has a tan delta value of $\leqq 0.75$.

10. The process of claim 9, wherein the lubricant additive gel is formed by the gellation of at least two lubricant additives selected from the group consisting of detergents, dispersants, acids, bases, over based detergents and combinations thereof.

11. The process of claim 10, wherein the dispersant is selected from the group comprising an N-substituted long chain alkenyl succinimides, polylsobitenyl succinimide, a high molecular weight ester, a Mannich base, an amine dispersant, a polymeric dispersant or mixtures thereof and the detergent is selected from the group comprising a sulfonate, phenate, salicylate carboxylate or mixtures thereof.

12. An oil filter for lubricated systems comprising a housing, a filter for removing particulate matter from the oil passing through the filter and lubricant additives for slow release into the oil, wherein the lubricant additives are in the form of a lubricant additive gel wherein the lubricant additive gel has a tan delta value of $\leqq 0.75$.

13. An oil filter of claim 12, wherein the lubricant additive gel is formed by the gellation of at least two lubricant additives selected from the group consisting of detergents, dispersants, acids, bases, overbased detergents and combinations thereof.

14. The oil filter of claim 13, wherein the detergent is an overbased detergent having a TBN of at least 300 and further wherein the dispersant is a polyisobutenyl succinimide having at least one of the following properties:

(a) the N:CO ratio of the polyisobutenyl succinimide is 0.6 to 1.6, (b) the maleic anhydride conversion level of the polyisobutenyl succinimide is at least about 1.3, (c) the Mn of the polyisobutenyl segment of the polyisobutenyl succinimide is at least about 1200, and (d) the polyisobutenyl succinimide is made by $Cl_2$-assisted succination.

* * * * *